US007427038B2

(12) United States Patent
Wang et al.

(10) Patent No.: US 7,427,038 B2
(45) Date of Patent: Sep. 23, 2008

(54) DUAL-AXIS ROTATING SPRINKLER

(76) Inventors: Po-Hsiung Wang, No. 91, Kwo-Tai Rd., Chu-Nan Chen, Miao-Li Hsien (TW); Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 291 days.

(21) Appl. No.: 11/271,804

(22) Filed: Nov. 14, 2005

(65) Prior Publication Data

US 2007/0119977 A1 May 31, 2007

(51) Int. Cl.
*B05B 3/04* (2006.01)

(52) U.S. Cl. ..... 239/240; 239/242; 239/243; 239/381; 239/391; 239/394; 239/447; 239/587.5; 239/DIG. 15

(58) Field of Classification Search ..... 239/237, 239/240, 242, 243, 263, 263.3, 264, 265, 239/381, 389, 391, 394, 447, DIG. 15, 587.1, 239/587.5
See application file for complete search history.

(56) References Cited

U.S. PATENT DOCUMENTS

| | | | | |
|---|---|---|---|---|
| 2,253,979 | A | 8/1941 | De-Lacy-Mulhall | |
| 3,934,820 | A | 1/1976 | Phaup | |
| 4,417,691 | A | 11/1983 | Lockwood | |
| 4,925,098 | A | 5/1990 | Di Paola | |
| 5,174,501 | A | 12/1992 | Hadar | |
| 5,330,103 | A | 7/1994 | Eckstein | |
| 5,772,117 | A * | 6/1998 | Su | 239/240 |
| 6,540,163 | B1 * | 4/2003 | Huang | 239/587.5 |
| 6,732,950 | B2 | 5/2004 | Ingham, Jr. et al. | |
| 7,191,958 | B1 * | 3/2007 | Wang | 239/200 |

* cited by examiner

*Primary Examiner*—Len Tran
*Assistant Examiner*—Jason J Boeckmann
(74) *Attorney, Agent, or Firm*—Bacon & Thomas, PLLC

(57) ABSTRACT

A dual-axis rotating sprinkler has a nozzle, an adjusting assembly, a rotating assembly and an adapting tube. The adjusting assembly is attached to the nozzle. Pivoting the adjusting assembly easily changes the elevation angle of the nozzle to change the spray area. The rotating assembly is attached to the adjusting assembly. The adapting tube is mounted around the rotating assembly, connects to the water pipe to allow the water passing through the adapting tube and filling into the rotating assembly. The water drives the rotating assembly to rotate the adjusting assembly. Therefore, the dual-axis rotating sprinkler rotates by the rotating assembly to spray in all directions and can be pivoted by the adjusting assembly to change the spray area.

4 Claims, 10 Drawing Sheets

DUAL-AXIS ROTATING SPRINKLER

BACKGROUND OF THE INVENTION

1. Field of the Invention

The present invention relates to a rotating sprinkler, especially to a dual-axis rotating sprinkler.

2. Description of the Prior Arts

Sprinklers are usually mounted in meadows, fields or lawns to spray water. A conventional sprinkler automatically rotates 360 degrees to spray water to all directions. The angle of elevation of a conventional sprinkler determines the size of the spray area of the conventional sprinkler. Changing the angle of elevation changes the spray area. When the angle of elevation increases, the spray area decreases. However, the angle of elevation of a conventional sprinkler is usually fixed or is hard to change. To change the spray area, the user must use tools to change the angle of elevation of the conventional sprinkler or must reposition the sprinkler.

To overcome the shortcomings, the present invention provides a dual-axis rotating sprinkler to mitigate or obviate the aforementioned problems.

SUMMARY OF THE INVENTION

The main objective of the present invention is to provide a dual-axis rotating sprinkler. The dual-axis rotating sprinkler has a nozzle, an adjusting assembly, a rotating assembly and an adapting tube. The adjusting assembly is attached to the nozzle. Pivoting the adjusting assembly easily changes the angle of elevation of the nozzle to change the spray area. The rotating assembly is attached to the adjusting assembly. The adapting tube is mounted around the rotating assembly, connects to the water pipe to allow the water to pass through the adapting tube and fill the rotating assembly. The water drives the rotating assembly to rotate the adjusting assembly. Therefore, the dual-axis rotating sprinkler is rotated by the rotating assembly to spray water in all directions and is pivoted by the adjusting assembly to change the spray area.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
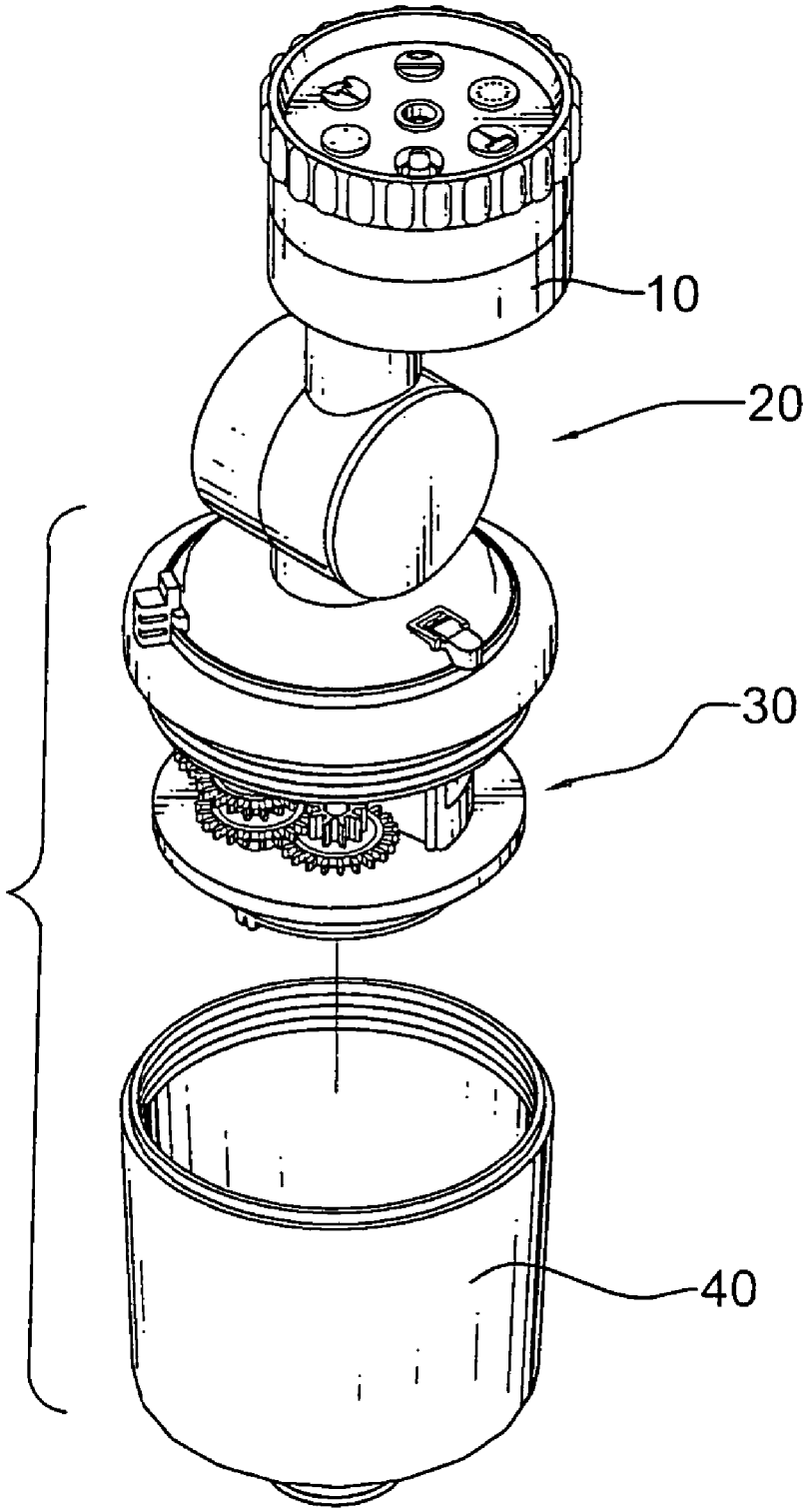
FIG. 1 is a partially exploded perspective view of a dual-axis rotating sprinkler in accordance with the present invention.
Figure 2:
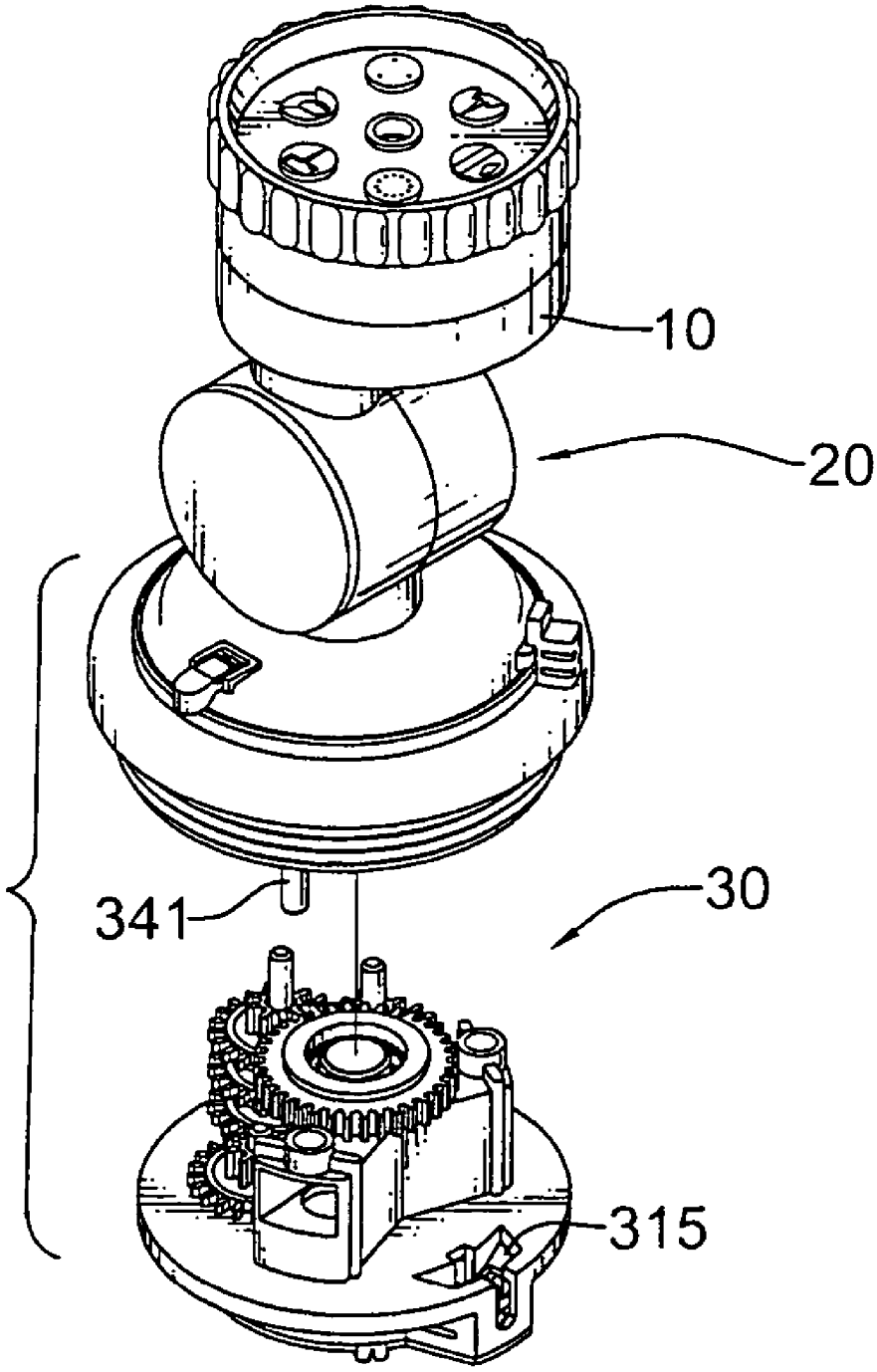
FIG. 2 is a partially exploded perspective view of the dual-axis rotating sprinkler in FIG. 1 without an adapting tube.

With reference to FIGS. 1 and 2, a dual-axis rotating sprinkler in accordance with the present invention comprises a nozzle (10), an adjusting assembly (20), a rotating assembly (30) and an adapting tube (40).

Figure 3:
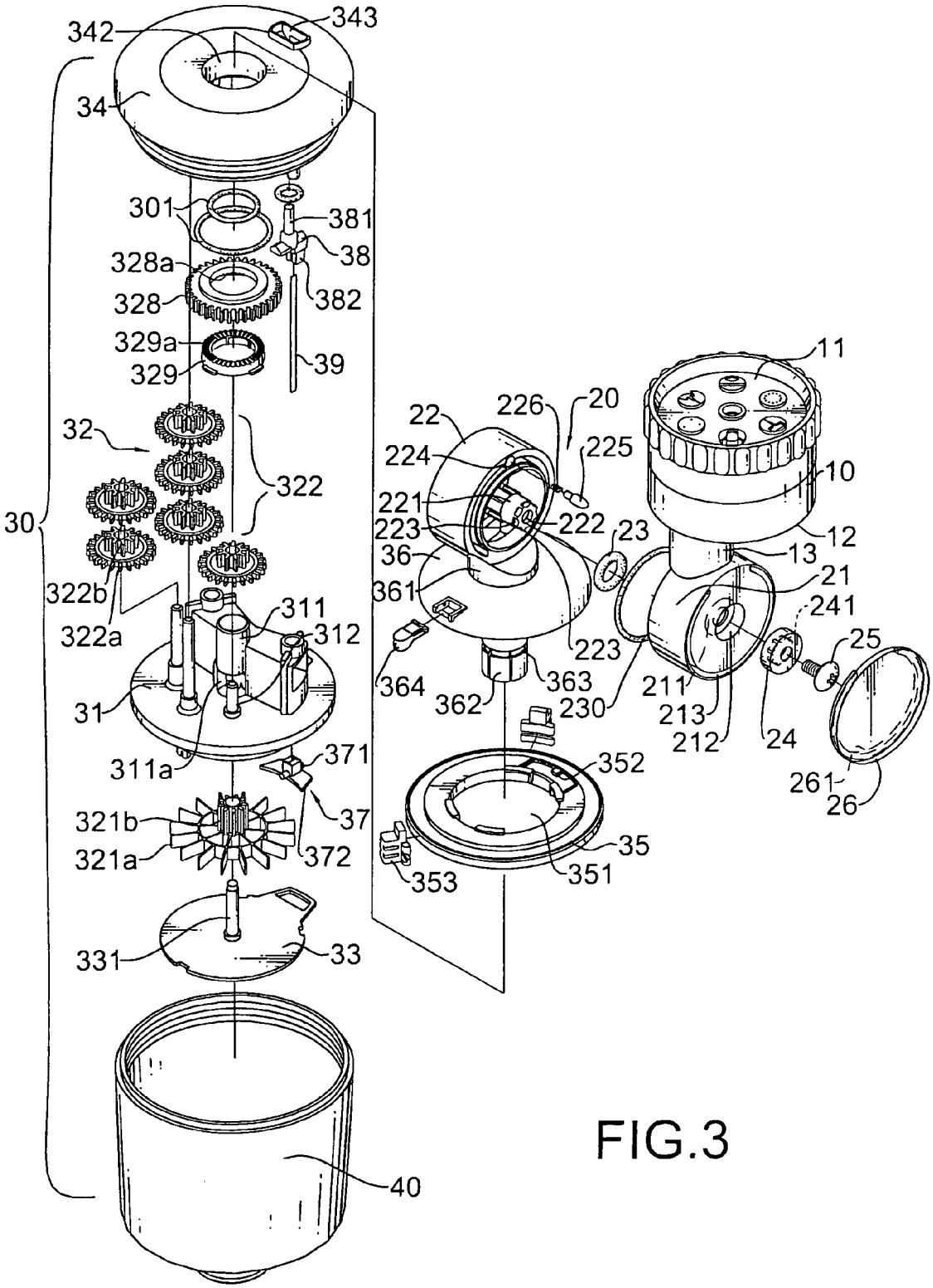
FIG. 3 is an exploded perspective view of the dual-axis rotating sprinkler in FIG. 1.

With further reference to FIG. 3, the nozzle (10) has an outlet end (11), an inlet end (12) and an extension tube (13). The extension tube (13) is formed on the inlet end (12) and has an axis.

The adjusting assembly (20) connects to the nozzle (10) and has a rotating segment (21), a stationary segment (22), multiple washers (23, 230), a holding disk (24), a fastener (25) and a side cover (26).

Figure 4:
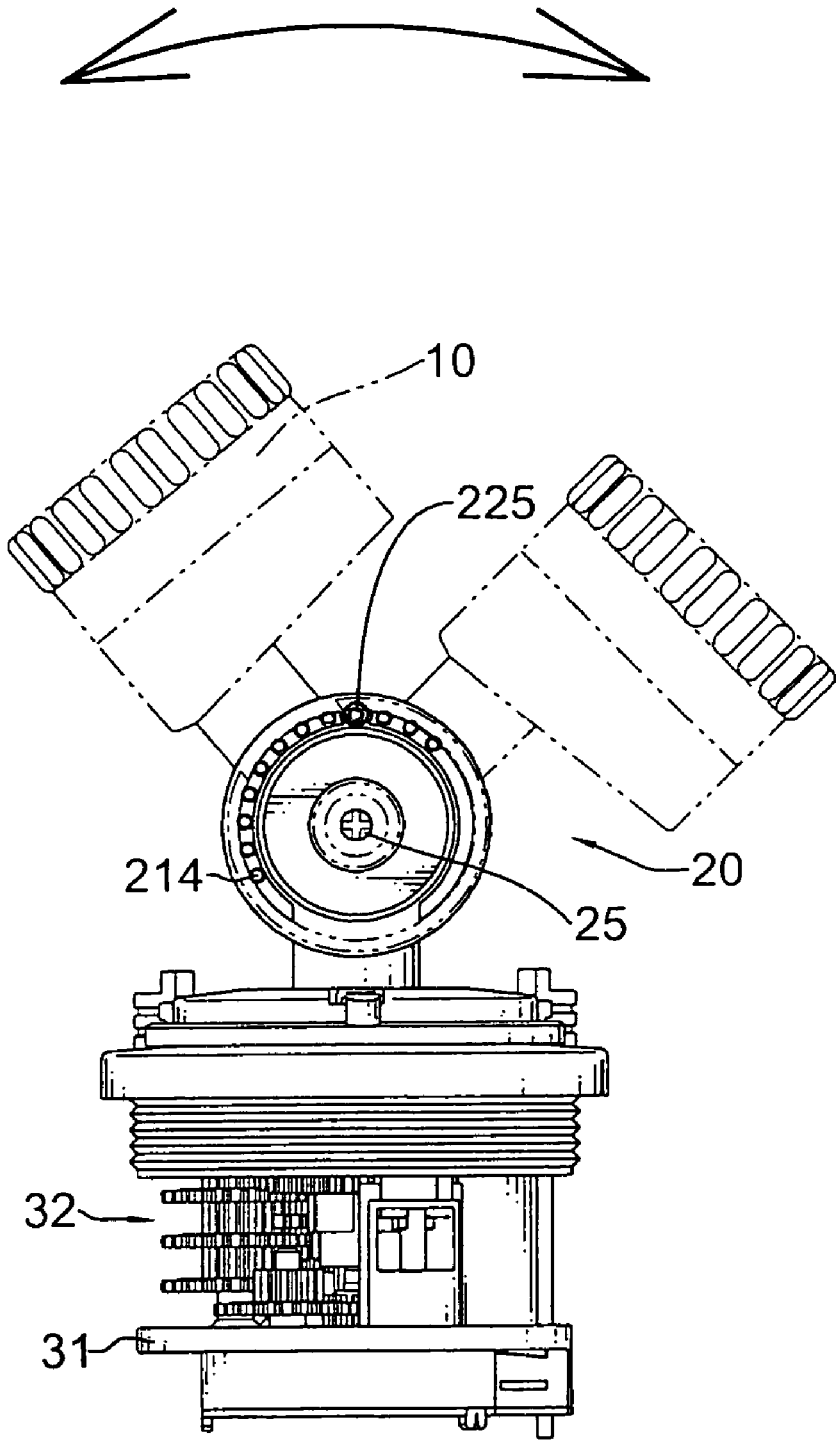
FIG. 4 is an operational side view of the dual-axis rotating sprinkler in FIG. 2.

With further reference to FIG. 4, the rotating segment (21) is formed on and communicates with the extension tube (13), has an axis, an edge, an inside surface, an outside surface, a central hole (211), a recess (212), an annular slot (213) and multiple positioning detents (214). The axis of the rotating segment (21) is perpendicular to the axis of the extension tube (13). The central hole (211) is formed through the inside and outside surfaces of the rotating segment (21). The recess (212) is formed in the outside surface of the rotating segment (21) and corresponds to the central hole (211) of the rotating segment (21). The annular slot (213) is formed in the outside surface along the edge of the rotating segment (21). The positioning detents (214) are formed separately in the inside surface along the edge of the rotating segment (21).

The stationary segment (22) communicates with and is coaxially mounted pivotally on the rotating segment (21) to allow the rotating segment (21) to pivot on the stationary segment (22). The stationary segment (22) may have an edge, an inside surface, an outside surface, a protruding rod (221), a fastening hole (222), multiple pawls (223), a socket (224), a retainer (225) and a spring (226). The protruding rod (221) is formed coaxially in the stationary segment (22), extends out from the inside surface of the stationary segment (22), extends through the central hole (211) in the rotating segment (21) and has a sidewall and a distal end. The distal end of the protruding rod (221) is held in the recess (212) in the rotating segment (21). The fastening hole (222) is formed axially in the protruding rod (221) and may be a screw hole. The pawls (223) are formed continuously on the sidewall around the distal end of the protruding rod (221) and are held in the recess (212) in the rotating segment (21). The socket (224) is formed in the inside surface of the stationary segment (22) adjacent to the edge. The retainer (225) is mounted in the socket (224) in the stationary segment (22) and selectively engages the positioning detents (214) in the rotating segment (21) to hold the rotating segment (21) in place. The spring (226) is mounted in the socket (224) in the stationary segment (22) and is compressed by the retainer (225).

The washers (23, 230) are mounted in the rotating and stationary segments (21, 22) to keep water from leaking out.

The holding disk (24) is mounted in the recess (212) in the rotating segment (21), is mounted around the protruding rod (221) of the stationary segment (22) and has an inside surface and a ratchet recess (241). The ratchet recess (241) is formed in the inside surface of the holding disk (24) and corresponds to and engages the pawls (223) of the stationary segment (22) to hold the holding disk (24) on the protruding rod (221).

The fastener (25) engages the fastening hole (222) in the protruding rod (221), abuts the holding disk (24) and may be a screw.

The side cover (26) is mounted on the outside surface of the rotating segment (21) and has an edge, an inside surface and an annular rib (261). The annular rib (261) is formed on the inside surface of the side cover (26) along the edge and corresponds to and engages the annular slot (213) in the rotating segment (21).

The rotating assembly (30) communicates and is attached to the adjusting assembly (20) to rotate the adjusting assembly (20) and the nozzle (10). The rotating assembly (30) may have a base (31), a top cover (34), a switch disk (35), a connecting disk (36), a gear assembly (32), a bottom cover (33), a valve element (37), a switch rod (38) and a resilient strip (39).

Figure 5:
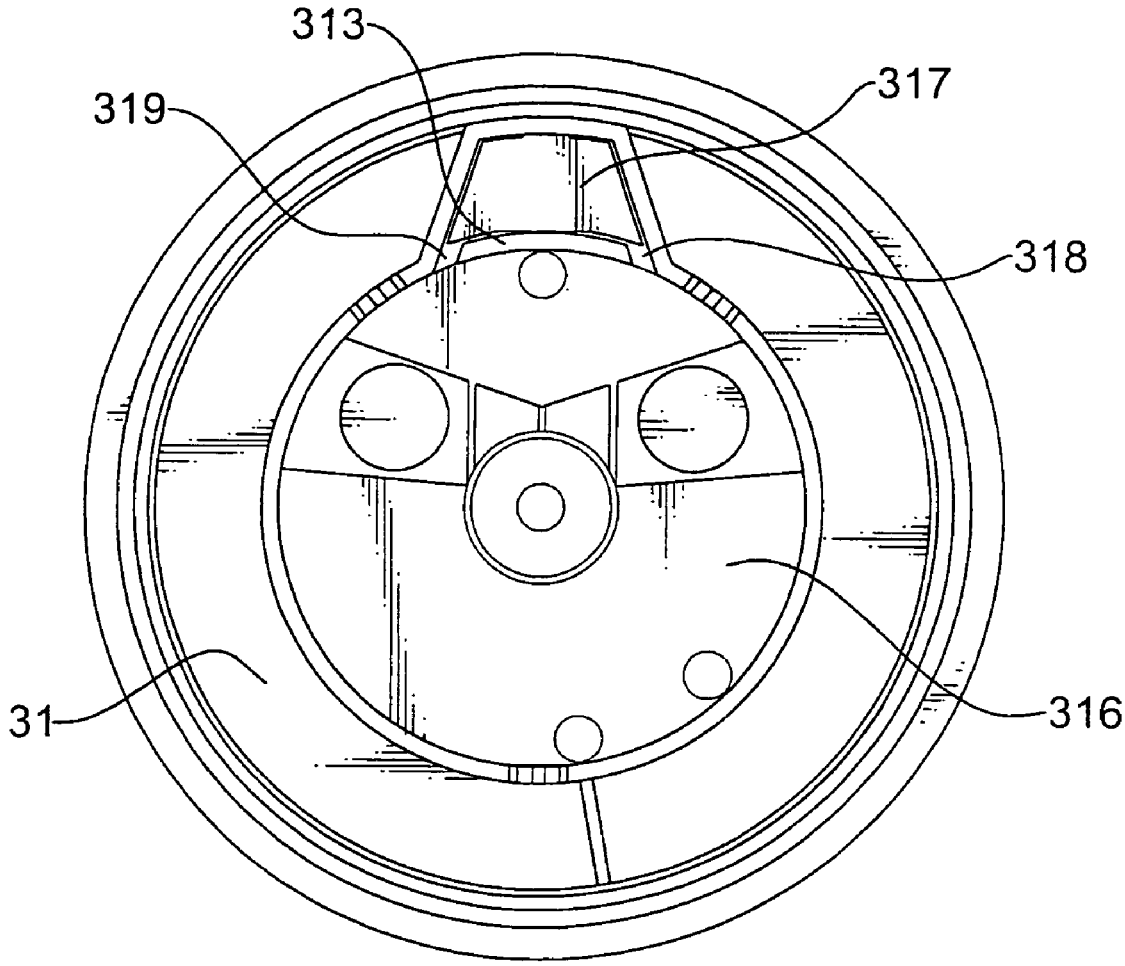
FIG. 5 is a bottom view of the dual-axis rotating sprinkler in FIG. 2.
Figure 7:
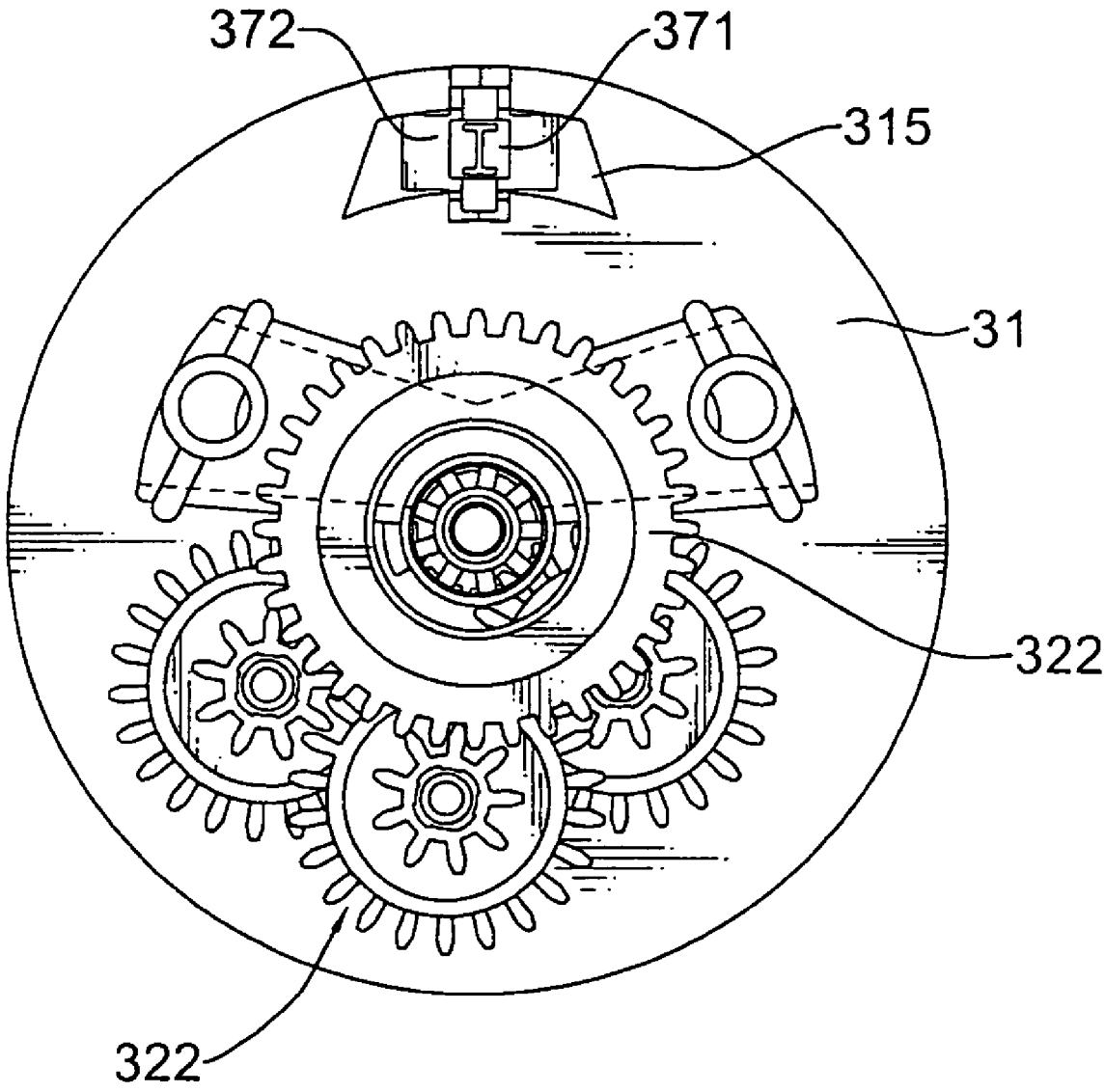
FIG. 7 is a top view of the gear assembly and the base in FIG. 6.
Figure 8:
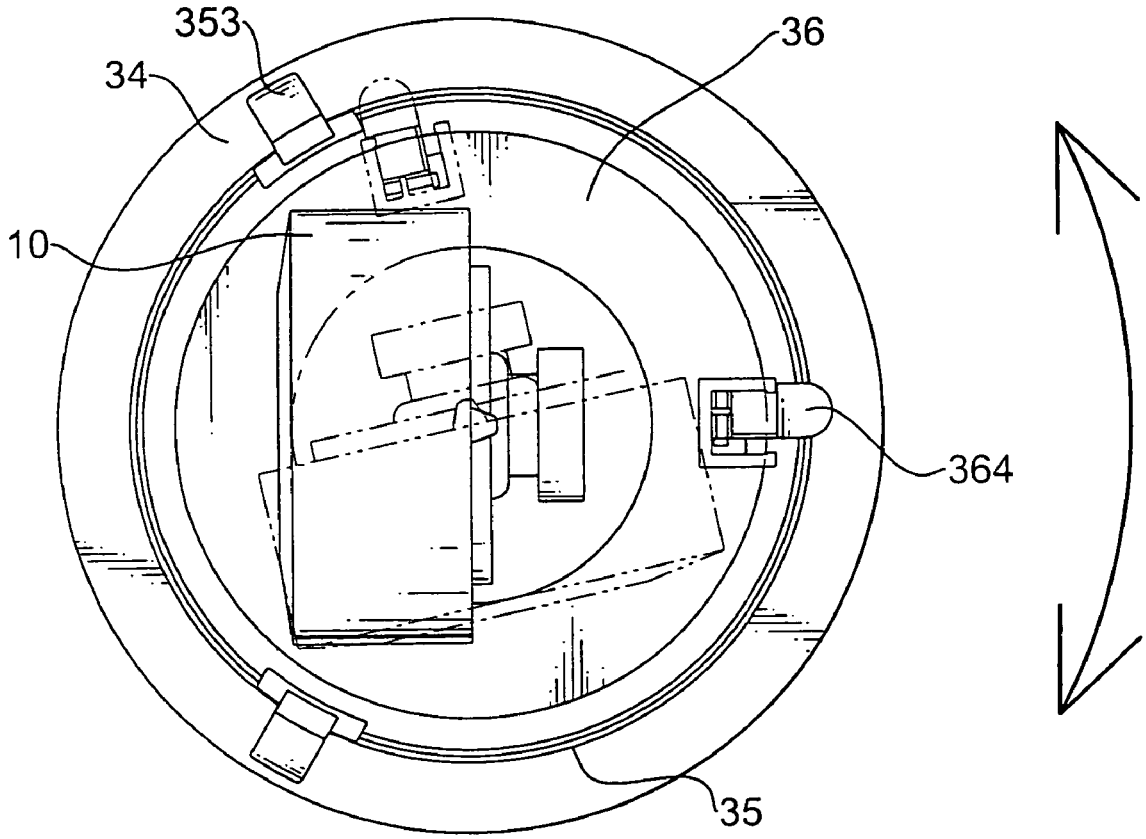
FIG. 8 is an operational top view of the dual-axis rotating sprinkler in FIG. 1.

With further reference to FIGS. 5 and 7, the base (31) has an edge, a top surface, a bottom surface, a central tube (311), multiple shafts (312), a valve hole (315), a containing chamber (316), an inlet chamber (317), a partition (313), a first gap (318) and a second gap (319). The central tube (311) is formed on the top surface of the base (31) and has a sidewall and a notch (311*a*). The notch (311*a*) is formed through the sidewall of the central tube (311). The shafts (312) are formed separately on the top surface of the base (31). One of the shafts (312) is adjacent to the notch (311*a*) of the central tube (311). The valve hole (315) is formed through the sidewall of the central tube (311). The containing chamber (316) is formed in the bottom surface of the base (31) and corresponds to and communicates with the central tube (311). The inlet chamber (317) is formed in the bottom surface of the base (31) adjacent to the containing chamber (311) and corresponds to and communicates with the valve hole (315). The partition (313) is formed between the containing chamber (316) and the inlet chamber (317) and has two ends. The first and second gaps (318, 319) are formed respectively in the two ends of the partition (313) to communicate the containing chamber (316) with the inlet chamber (317).

The top cover (34) is mounted securely on the base (31) and has a top surface, a bottom surface, multiple supports (341), a central hole (342) and a through hole (343). The supports (341) are formed on the bottom surface of the top cover (34) and are attached to the base (31) to mount the top cover (34) securely on the base (31). The central hole (342) is formed through the top and bottom surfaces of the top cover (34) and corresponds to the central tube (311) on the base (31). The through hole (343) is formed through the top and bottom surfaces of the top cover (34) and corresponds to the valve hole (315) in the base (31).

The switch disk (35) is mounted on the top surface of the top cover (34) and has an edge, a top surface, a bottom surface, a central hole (351), an embedded recess (352) and two stops (353). The central hole (351) is formed through the top and bottom surfaces of the switch disk (35) and corresponds to the central hole (342) in the top cover (34). The embedded recess (352) is formed in the bottom surface of the switch disk (35) and corresponds to the through hole (343) in the top cover (34). The stops (353) are movably clamped on the edge of the switch disk (35) and extend radially out of the edge of the switch disk (35).

The connecting disk (36) is attached to the stationary segment (22) of the adjusting assembly (20) and has an edge, a top surface, a bottom surface, a linking tube (361), a mounting tube (362) and a limit (364). The linking tube (361) is formed on the top surface of the connecting disk (36) and communicates with and is attached to the stationary segment (22) of the adjusting assembly (20). The mounting tube (362) is formed on the bottom surface of the connecting disk (36), extends through the central holes (351, 342) in the switch disk (35) and top cover (34), communicates with the linking tube (361) and the central tube (311) on the base (31) and has a sidewall and an annular recess (363). The annular recess (363) is formed in the outer sidewall of the mounting tube (362). The limit (364) is mounted pivotally on and extends radially out of the edge of the connecting disk (36). When the limit (364) is pivoted to correspond to the stops (353), the limit (364) selectively abuts the stops (353).

Figure 6:
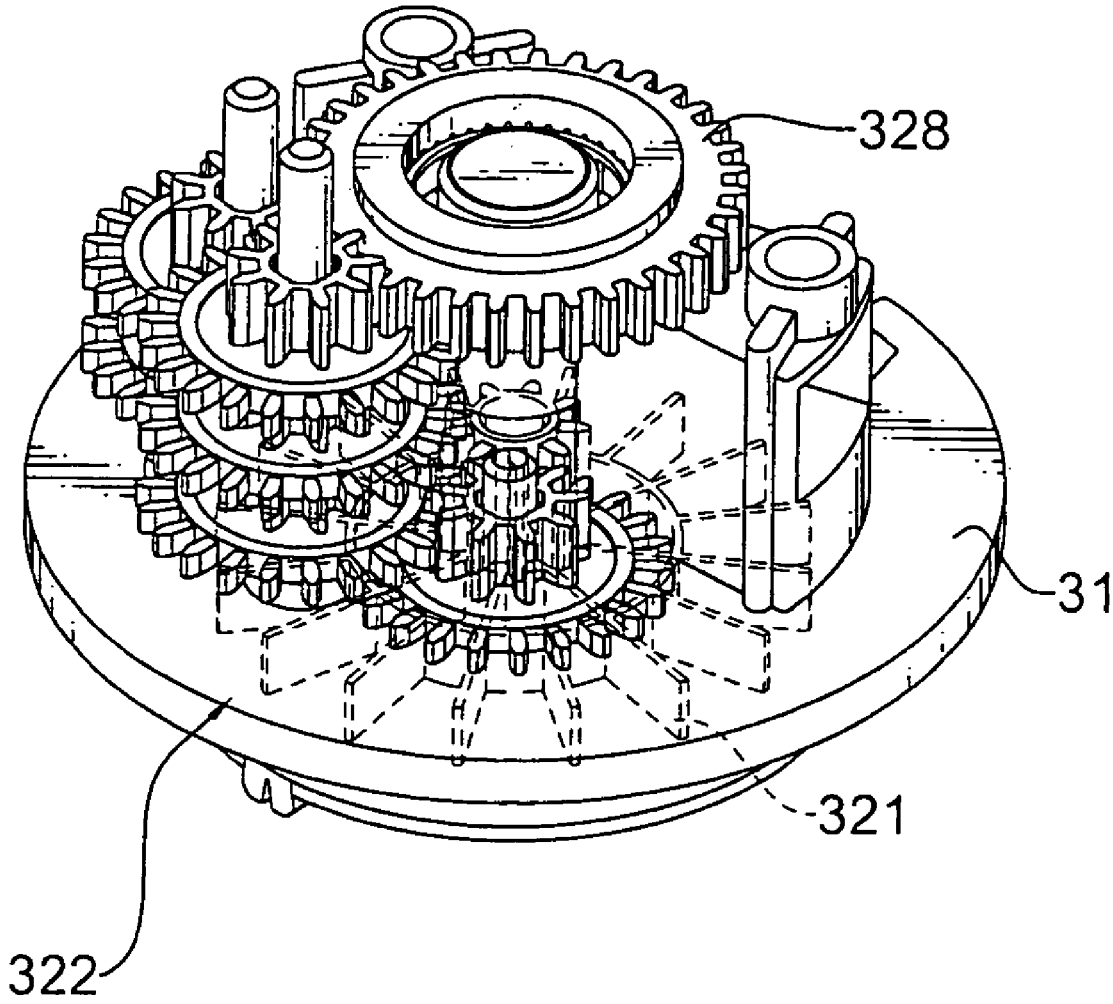
FIG. 6 is a perspective view of a gear assembly and a base of the dual-axis rotating sprinkler in FIG. 1.

With further reference to FIG. 6, the gear assembly (32) has a main driving gear (321), a reduction gear assembly (322), a final drive gear (328) and a ratchet gear (329). The main driving gear (321) is mounted rotatably in the containing chamber (316) in the base (31) and comprises a turbine (321*a*) and a transfer gear (321*b*). The turbine (321*a*) and the transfer gear (321*b*) are coaxial and the turbine (321*a*) is larger than the transfer gear (321*b*). The transfer gear (321*b*) corresponds to and extends through the notch (311*a*) in the central tube (311) on the base (31). The reduction gear assembly (322) is mounted pivotally around the shafts (313) on the base (31) and comprises multiple reduction gears engaging in sequence. Each reduction gear has a driven gear (322*a*) and a transfer gear (322*b*). The driven gear (322*a*) and the transfer gear (322*b*) are coaxial and the driven gear (322*a*) is larger than the transfer gear (322*b*). Each driven gear (322*a*) of a reduction gear engages the transfer gear (322*b*) of a former reduction gear. The driven gear (322*a*) of the initial reduction gear engages the transfer gear (321*b*) of the main driving gear (321). Because all the driven gears (322*a*) are larger than the transfer gears (322*b*) and the driven gear (322*a*) of a reduction gear engages the transfer gear (322*b*) of a former reduction gear, the rotating speed will be reduced from the initial reduction gear to the final reduction gear. The final drive gear (328) is mounted around the mounting tube (362) of the connecting disk (36), engages the transfer gear (322*b*) of the final gear of the reduction gear assembly (322) and has a surface and a ratchet recess (328*a*). The ratchet recess (328*a*) is formed in the lower surface of the final drive gear (328). The ratchet gear (329) is mounted securely in the annular recess (363) in the mounting tube (362) and has a surface and multiple ratchet teeth (329*a*). The ratchet teeth (329*a*) are formed on the surface of the ratchet gear (329) and engage the ratchet recess (328*a*) in the final drive gear (328).

The bottom cover (33) is mounted on and covers the containing chamber (316) in the bottom surface of the base (31) and has a top surface and a post (331). The post (331) is formed on the top surface of the bottom cover (33) and extends through the main driving gear (321) to allow the main driving gear (321) to be mounted rotatably.

The valve element (37) is mounted pivotally in the valve hole (315) in the base (31) and has a clamp (371) and two wings (372). The clamp (371) is mounted pivotally in the valve hole (315). The wings (372) are formed on opposite sides of the clamp (371) and alternately seal the first and second gaps (318, 319) of the partition (313).

The switch rod (38) is mounted in the through hole (343) in the top cover (34) and has a top surface, a bottom surface, a protrusion (381) and a clamp (382). The protrusion (381) is formed on the top surface of the switch rod (38) and engages the embedded recess (352) in the switch disk (35). The clamp (382) is formed on the bottom surface of the switch rod (38).

The resilient strip (39) has two ends respectively engaged in the clamps (371, 382) of the valve element (37) and the switch rod (38).

The adapting tube (40) is mounted around and communicates with the rotating assembly (30), may communicate with the inlet chamber (317) of the base (31) and connects to a water pipe to allow water to pass through the adapting tube (40) to the rotating assembly (30).

The water flows into the inlet chamber (317) of the base (31) and rotates the main driving gear (321). The main driving gear (321) rotates the reduction gear assembly (322). The reduction gear assembly (322) rotates the final drive gear (328). The final drive gear (328) rotates the ratchet gear (329). The ratchet gear (329) rotates the mounting tube (362). Then the adjusting assembly (20) and the nozzle (10) are rotated.

Figure 9:
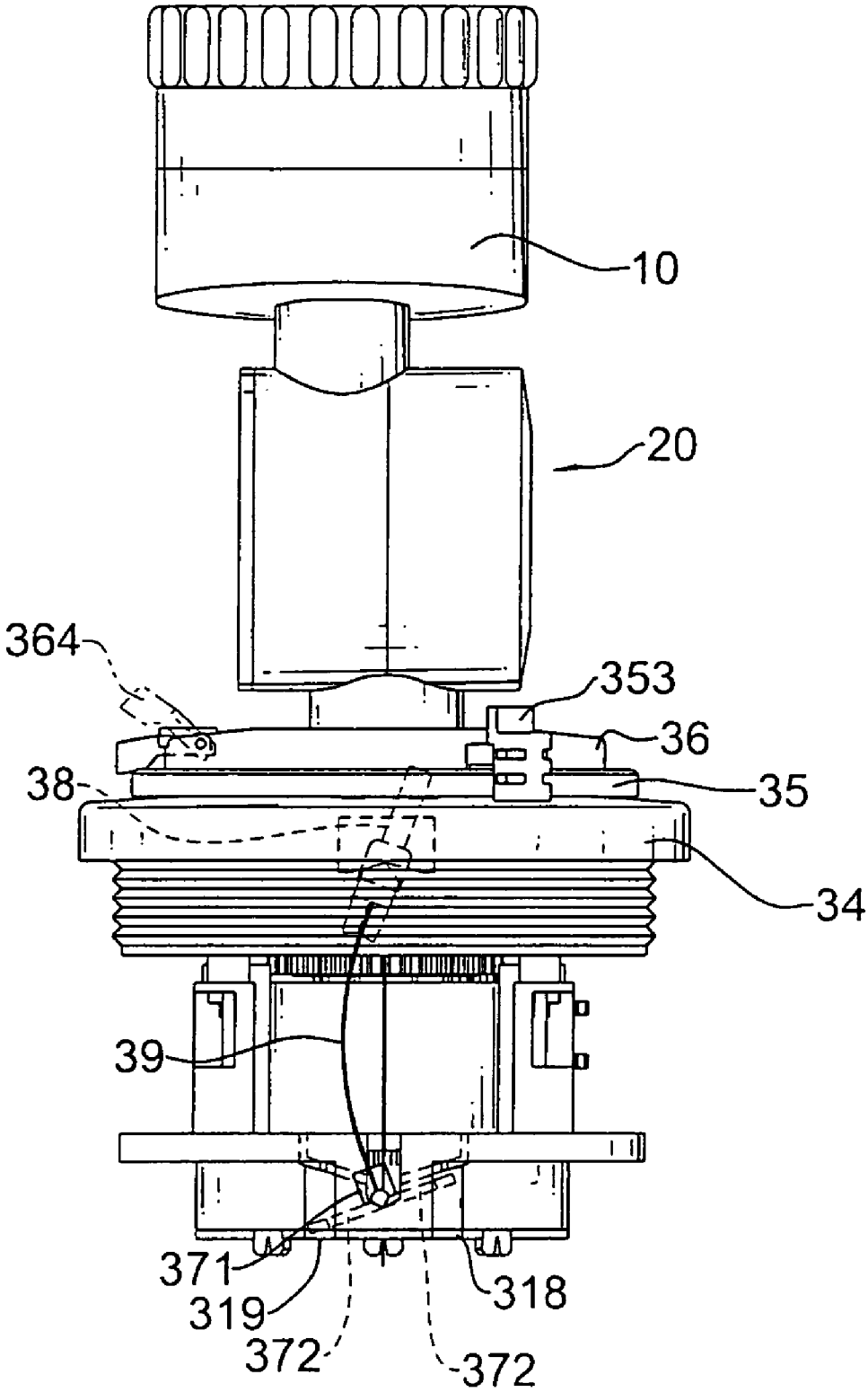
FIG. 9 is an operational side view of the dual-axis rotating sprinkler in FIG. 2.
Figure 10:
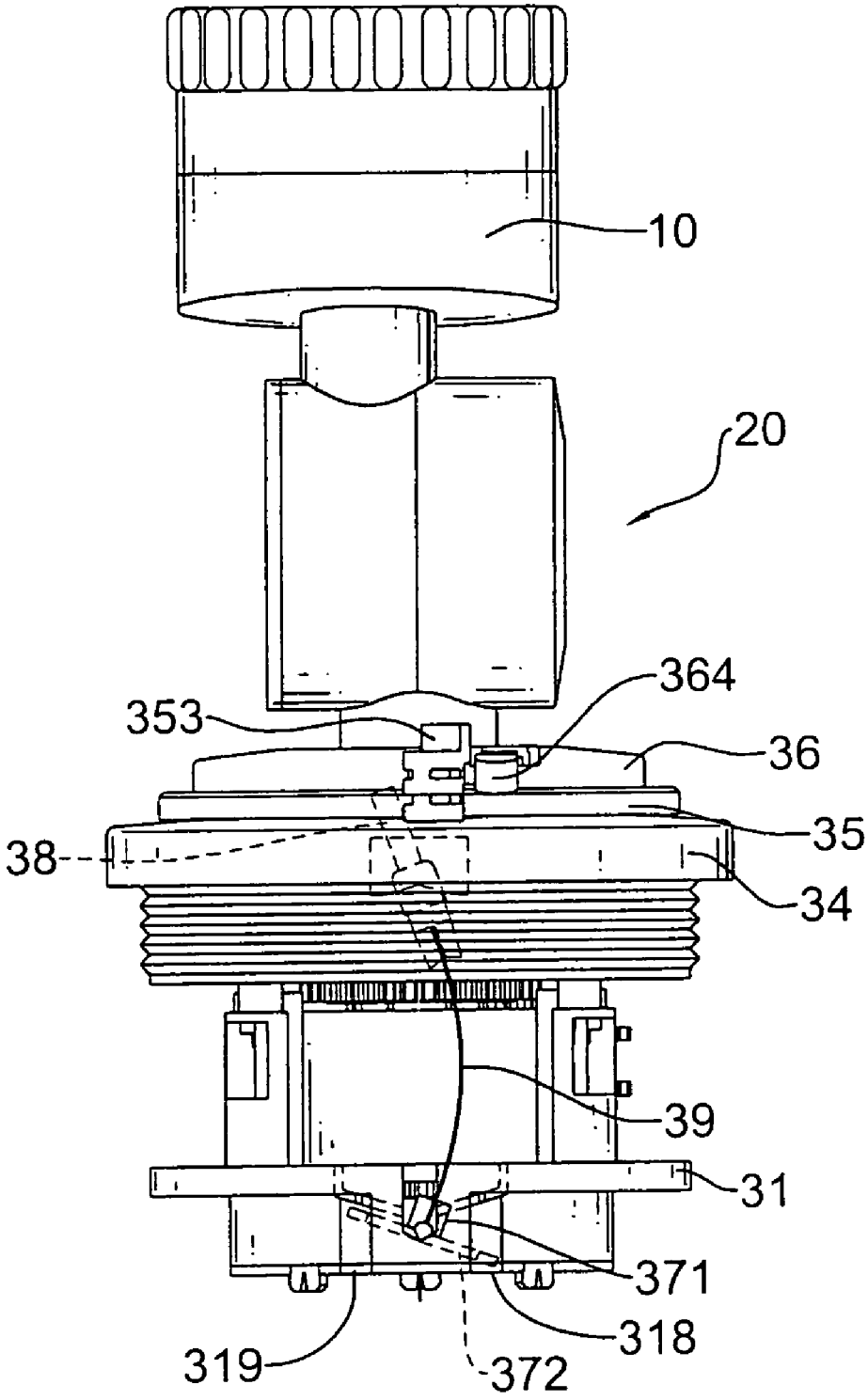
FIG. 10 is an operational side view of the dual-axis rotating sprinkler in FIG. 2.

With further reference to FIG. 9, one of the wings (372) seals the second gap (319) in the partition board (313) allowing the water to flow into the inlet chamber (317) only through the first gap (318). When the limit (364) abuts one of the stops (353), the switch disk (35) moves and pivots the valve element (37). Then the other wing (372) seals the first gap (318) in the partition (313) allowing the water to flow into the inlet chamber (317) only through the second gap (319). Therefore, the direction of rotation of the main driving gear (321) reverses causing the rotation of the adjusting assembly (20) and the nozzle (10) to reverse as well.

The present invention not only has the rotating assembly (30) to rotate the nozzle (10) so the sprinkler can spray in all directions, but also has the adjusting assembly (20) with which the angle of elevation of the nozzle can be easily changed to change the spray area.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dual-axis rotating sprinkler comprising:

a nozzle having
- an outlet end;
- an inlet end; and
- an extension tube formed on the inlet end and having an axis;

an adjusting assembly connecting to the nozzle and having
- a rotating segment formed on and communicating with the extension tube and having
  - an axis perpendicular to the axis of the extension tube;
  - an edge;
  - an inside surface;
  - an outside surface;
  - a central hole formed through the inside and outside surfaces of the rotating segment;
  - a recess formed in the outside surface of the rotating segment and corresponding to the central hole of the rotating segment; and
  - multiple positioning detents formed separately in the inside surface along the edge of the rotating segment;
- a stationary segment communicating with and coaxially mounted pivotally on the rotating segment to allow the rotating segment to pivot on the stationary segment and having
  - an edge;
  - an inside surface;
  - an outside surface;
  - a protruding rod formed coaxially in the stationary segment, extending out from the inside surface of the stationary segment passing through the central hole in the rotating segment and having a sidewall and a distal end;
  - a fastening hole formed axially in the protruding rod;
  - a socket formed in the inside surface of the stationary segment adjacent to the edge;
  - a retainer mounted in the socket in the stationary segment and selectively engaging the positioning detents in the rotating segment to hold the rotating segment in place;
  - a spring mounted in the socket in the stationary segment and compressed by the retainer; and
  - multiple pawls formed continuously around the sidewall around the distal end of the protruding rod and in the recess in the rotating segment;
- multiple washers mounted in the rotating and stationary segments;
- a holding disk mounted in the recess in the rotating segment, mounted around the protruding rod of the stationary segment and having
  - an inside surface; and
  - a ratchet recess formed in the inside surface of the holding disk and corresponding to and engaging the pawls of the stationary segment to hold the holding disk on the protruding rod; and
- a fastener engaging the fastening hole in the protruding rod and abutting the holding disk;

a rotating assembly communicating and attached to the adjusting assembly to rotate the adjusting assembly and the nozzle; and an adapting tube mounted around and communicating with the rotating assembly.

2. The dual-axis rotating sprinkler as claimed in claim 1, wherein the rotating segment has an annular slot formed in the outside surface along the edge of the rotating segment; and the adjusting assembly has a side cover mounted on the outside surface of the rotating segment and having
- an edge;
- an inside surface; and
- an annular rib formed on the inside surface of the side cover along the edge and corresponding to and engaging in the annular slot in the rotating segment.

3. The dual-axis rotating sprinkler as claimed in claim 2, wherein the fastening hole of the stationary segment is a screw hole; and the fastener of the adjusting assembly is a screw.

4. The dual-axis rotating sprinkler as claimed in claim 3, wherein the rotating assembly has a base having
- an edge;
- a top surface;
- a bottom surface;
- a central tube formed on the top surface of the base and having
  - a sidewall; and
  - a notch formed through the sidewall of the central tube;
- multiple shafts;
- a valve hole formed through the sidewall of the central tube;
- a containing chamber formed in the bottom surface of the base and corresponding to and communicating with the central tube;
- an inlet chamber formed in the bottom surface of the base adjacent to the containing chamber and corresponding to and communicating with the valve hole;
- a partition formed between the containing chamber and the inlet chamber and having two ends; and a first gap and a second gap formed respectively in the two ends of the partition to communicate the containing chamber with the inlet chamber;

a top cover mounted securely on the base and having a top surface;

a bottom surface;

multiple supports formed on the bottom surface of the top cover and attached to the base to mount the top cover securely on the base;

a central hole formed through the top and bottom surfaces of the top cover and corresponding to the central tube on the base; and a through hole formed through the top and bottom surfaces of the top cover and corresponding to the valve hole in the base;

a switch disk mounted on the top surface of the top cover and having an edge;

a top surface;

a bottom surface;

a central hole formed through the top and bottom surfaces of the switch disk and corresponding to the central hole in the top cover;

an embedded recess formed in the bottom surface of the switch disk and corresponding to the through hole in the top cover; and two stops movably clamping on the edge of the switch disk and extending radially out of the edge of the switch disk;

a connecting disk attached to the stationary segment of the adjusting assembly and having an edge;

a top surface;

a bottom surface;

a link tube formed on the top surface of the connecting disk and communicating with and attached to the stationary segment of the adjusting assembly;

a mounting tube formed on the bottom surface of the connecting disk, extending through the central holes in the switch disk and top cover, communicating with the linking tube and the central tube on the base and having a sidewall; and an annular recess formed in the sidewall of the mounting tube; and a limit mounted pivotally on and extending radially out of the edge of the connecting disk wherein when the limit is pivoted to correspond to the stops, the limit selectively abuts the stops;

a gear assembly having a main driving gear mounted pivotally in the containing chamber in the base and comprising a turbine; and a transfer gear being coaxial to the turbine, being smaller than the turbine and corresponding to and extending through the notch in the central tube on the base;

a reduction gear assembly mounted pivotally around the shafts on the base and comprising multiple reduction gears engaging in sequence and including an initial reduction gear and a final reduction gear, and each reduction gear having a driven gear and a transfer gear, wherein the driven gear and the transfer gear are coaxial, the driven gear is larger than the transfer gear, each driven gear of the reduction gear engages the transfer gear of the former reduction gear and the driven gear of the initial reduction gear engages the transfer gear of the gear;

a final drive gear mounted around the mounting tube of the connecting disk, engaging the transfer gear of the final reduction gear of the reduction gear assembly and having a surface; and a ratchet recess formed in the surface of the inactive gear; and a ratchet gear mounted securely in the annular recess in the mounting tube and having a surface; and multiple ratchet teeth formed on the surface of the ratchet gear and engaging the ratchet recess in the inactive gear;

a bottom cover mounted on and covering the containing chamber in the bottom surface of the base and having a top surface; and a post formed on the top surface of the bottom cover and extending through the inactive gear to allow the inactive gear to be mount pivotally;

a valve element mounted pivotally in the valve hole in the base and having a clamp mounted pivotally in the valve hole; and two wings formed oppositely on the clamp and alternatively sealing the first and second gaps of the initial board;

a switch rod mounted in the through hole in the top cover and having a top surface;

a bottom surface;

a protrusion formed on the top surface of the switch rod and engaging the embedded recess in the switch disk; and a clamp formed on the bottom surface of the switch rod; and a resilient strip having two ends respectively engaging the clamps of the valve element and the switch rod.

* * * * *